United States Patent [19]

Cohn

[11] Patent Number: 4,642,741

[45] Date of Patent: Feb. 10, 1987

[54] FLUORESCENT LIGHTING SYSTEM

[75] Inventor: David W. Cohn, Chagrin Falls, Ohio

[73] Assignee: General Electric Company, Schenectady, N.Y.

[21] Appl. No.: 771,741

[22] Filed: Sep. 3, 1985

[51] Int. Cl.[4] ..... F21V 17/02

[52] U.S. Cl. ..... 362/320; 362/347; 362/377; 362/217

[58] Field of Search ..... 362/320, 306, 341, 347, 362/377, 217

[56] References Cited

U.S. PATENT DOCUMENTS

| | | | |
|---|---|---|---|
| 2,662,968 | 12/1953 | Saraber | 362/306 |
| 2,687,516 | 8/1954 | Schneiderman | 362/377 |
| 2,907,873 | 10/1959 | Smith | 362/306 |
| 3,644,730 | 2/1972 | Oyle, Jr. et al. | 362/347 |
| 3,654,471 | 4/1972 | Nilsson | 362/306 |
| 3,724,346 | 4/1973 | Armstrong | 362/306 |
| 4,061,422 | 12/1977 | Geurts et al. | 362/320 |
| 4,229,785 | 10/1980 | Tuller | 362/306 |
| 4,514,793 | 4/1985 | Andreasen | 362/306 |

FOREIGN PATENT DOCUMENTS

| | | | |
|---|---|---|---|
| 447687 | 4/1949 | Italy | 362/341 |

*Primary Examiner*—E. Rollins Cross

*Attorney, Agent, or Firm*—Nathan D. Herkamp; Philip L. Schlamp; Fred Jacob

[57] ABSTRACT

A conformable reflector is attached to the exterior surface of a fluorescent lamp tube in such fashion that it may be wrapped closely about the fluorescent lamp during shipping and handling, and upon installation of the fluorescent lamp-reflector system within a lighting fixture, the reflector may be extended to a position separated from the fluorescent lamp tube to form a reflecting surface which focuses the light emitted by the fluorescent lamp in a desired direction. The reflector may be permanently affixed to the fluorescent lamp tube, or may be fastened to the tube by adjustable collars which allow variation in the position of the reflector relative to the lighting fixture as desired by the user.

8 Claims, 5 Drawing Figures

FLUORESCENT LIGHTING SYSTEM

BACKGROUND OF THE INVENTION

1. Field of the Invention

The present invention relates to fluorescent lighting systems, and, more particularly, to a system including a conformable reflector attached to a fluorescent lamp tube such that the reflector can be wrapped around the fluorescent lamp prior to installation and can be extended after installation to conform to a desired shape.

2. Discussion of the Prior Art

In the operation of fluorescent lamps illumination is provided by the fluorescent lamp tube in every direction surrounding the axis of the fluorescent lamp. A substantial portion of the illumination which is emitted by the lamp in a direction other than toward the intended area illuminates the interior of a lighting fixture, the ceiling, walls or background material and is wasted light. This is particularly true when the lamps are installed in a fixture having no reflector on the side of the fluorescent tubes opposite the intended illuminated area. In fixtures having reflectors, the gradual accumulation of dust or other particles on the reflectors degrades the effectiveness of the reflector. These arrangements result in considerable inefficiency in lighting, because a significant part of the light emitted by the lamps is not useful in illuminating the intended area.

In the prior art various kinds of reflectors have been employed in conjunction with fluorescent lamp fixtures. For example, U.S. Pat. No. 3,654,471 issued to Nilsson on Apr. 4, 1972 describes a reflector device for use with a fluorescent lamp fixture. The reflector includes a profiled holder formed as a body having a cavity which provides support for a reflecting metal strip which is secured to the holder by stop members integral with the body of the holder which hold the reflecting metal strip in contact with the supporting surface of the holder. Such a reflector arrangement is a modification of a fixture design and would require replacement of fixtures in order to retrofit the reflector arrangement into existing installations. This requirement of fixture replacement would render such a configuration impractical in most facilities presently lighted by fluorescent lamps. U.S. Pat. No. 4,514,793 issued to Andreasen on Apr. 30, 1985 describes a different kind of reflector system for fluorescent lighting. Andreasen describes a rigid reflector which is attached to fluorescent lamps by securing elements such as spring straps to clamp the reflector to the fluorescent lamp tube. The rigid reflector of Andreasen provides one particular type of reflection pattern when attached to a fluorescent lamp installed in a fixture having sufficient space to accommodate the reflector. Each of the Nilsson and Andreasen discloses a specific design for a specific type of fixture. A reflector which is adaptable to essentially any type of fluorescent lamp fixture would be preferred for retrofit applications.

SUMMARY OF THE INVENTION

Accordingly, an object of the present invention is to provide a fluorescent lamp and reflector combination which is compatible with almost any type of fluorescent lamp fixture. A more specific object of the present invention is to provide a conformable reflector attached to a fluorescent lamp, such that the reflector can be wrapped around the fluorescent lamp tube for shipment and handling and can be extended to a desired shape upon installation in a fluorescent lamp fixture.

Accordingly, the fluorescent lighting system of the present invention provides a conformable reflector attached to a fluorescent lamp along at least some portion of the axial length of the lamp, having a length substantially equal to the lamp length and made of a conformable material which allows the reflector to be wrapped around the fluorescent lamp tube at the time of manufacture and at the time of installation to be extended away from the glass tube and into a desired shape for reflecting light output by the fluorescent lamp. In one particularly preferred embodiment of the present invention, the reflector comprises a conductive sheet which serves as a starting aid as well as a light reflector. In another particularly preferred embodiment the reflector is attached to the fluorescent lamp by a plurality of nonconducting sleeves which surround and frictionally engage the fluorescent lamp to enable positioning of the reflector in a desired orientation relative to the fluorescent lamp.

BRIEF DESCRIPTION OF THE DRAWINGS

Further objects and advantages of the present invention together with its organization, method of operation, and best mode contemplated may best be understood by reference to the following description taken in conjunction with the accompanying drawings in which.

DESCRIPTION OF THE PREFERRED EMBODIMENTS

Figure 1:
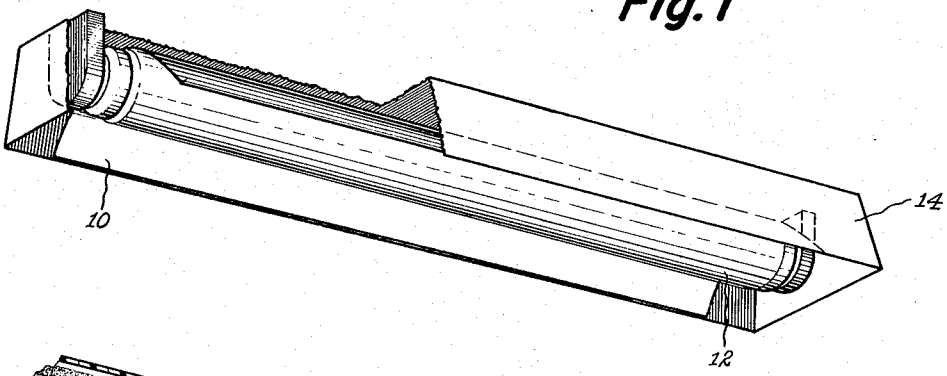
FIG. 1 is a schematic pictorial view with parts broken away illustrating one preferred embodiment of the present invention as installed in a lighting fixture.
Figure 2:
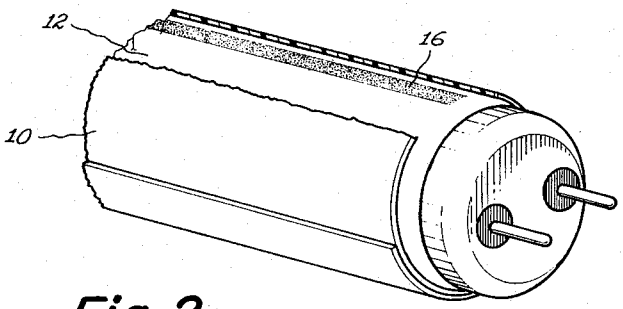
FIG. 2 is a partial schematic diagram of one end of the fluorescent lamp-reflector combination of FIG. 1.

As shown in FIG. 1 the lighting system of the present invention includes a conformable reflector 10 positioned between the lamp 12 and the fixture housing 14 when the lamp-reflector combination is installed in a conventional fluorescent lighting fixture. As used herein conformable is understood to mean sufficiently flexible to be wrapped about a fluorescent lamp and sufficiently resilient to retain a shape removed from the lamp when released. The reflector 10 is permanently attached to the glass tube 12 by a stripe of glue as shown at 16 in FIG. 2. The stripe 16 may extend the full length of the reflector or may be comprised of several short stripes aligned with the lamp along the reflector. As shown in FIG. 2 the reflector 10 is made of a conformable material, so that the reflector can be wrapped closely about the outer surface of the fluorescent tube 12 for shipment and handling, so that no additional space is required in the packaging and shipping containers for the lamp reflector combination of the present invention.

Figure 3:
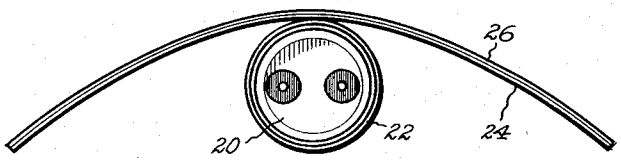
FIG. 3 is a schematic diagram illustrating a second preferred embodiment of the present invention with a particularly preferred attachment mechanism.

An alternative embodiment of the system of the present invention is illustrated schematically in FIG. 3. A collar of flexible material, such as a plastic, surrounds the lamp 20 and is glued into a ring 22 with a second strip 24 of flexible material, such as a plastic, glued to the collar to which the reflector sheet 26 is attached by, for example, gluing. A plurality of such collars are attached to the reflector along the axial length thereof with the number selected to provide the necessary support and shaping for the reflector. The collars 22 are made of such size that a frictional engagement exists between the exterior surface the glass tube of the lamp 20 and the inner surface of the collars with sufficient friction to allow positioning of the collars 22 and thereby the reflector 26 at any desired angular position relative to the axis of the fluorescent lamp. Other techniques of fastening the reflector to the fluoresent lamp are suitable, so long as the conformability of the reflector is maintained.

The fluorescent lamps with the attached conformable reflectors can be shipped as a single unit with the reflector and its support mechanism, if any, wrapped closely about the circumference of the fluorescent lamp. After installation of the fluorescent lamp tube in a lighting fixture, the reflector which is bound by a removable binding such as a removable adhesive or by adhesive tape or masking tape, is released to expand away from the surface of the fluorescent lamp. If the lamp and reflector combination is installed in a lighting fixture having a structure surrounding the lamps, the reflector, after release from its compact position, can be moved by the installer to conform a desired position and shape within the fixture, using the fixture as support. In a fixture in which the reflector may expand without interference the reflector will conform to its own natural shape which will be dictated by the resilience of the material of the reflector, the thickness of the reflector and the mechanism of attachment to the fluorescent lamp. One preferred material for the reflector is a coated plastic film sold by Flexcon Company, Inc. under the trademark Flexmark ®, MM series having a thickness of 2 mils and being metallized on one surface thereof. Alternatively, the reflector may comprise a sheet of Mylar ® plastic film sold by E.I. DuPont de Nemoirs and Company having a reflective metallized coating of aluminum or other suitable metal. Other compliant reflective materials or combinations of materials can be used, so long as the reflector has a reflectivity of about 70–100 percent, and preferably of about 85–100 percent.

Figure 4:
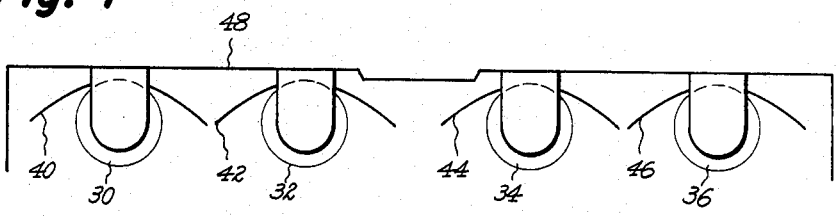
FIG. 4 is a schematic end view of a four lamp fluorescent lamp fixture with multiple lamp and reflector combinations installed.

As shown in FIG. 4 a plurality of lamps 30, 32, 34, 36 having suitable reflectors 40, 42, 44, 46 mounted thereon can be installed in a single multi-lamp fixture 48 to improve the illumination provided by the fixture without increasing the number of lamps used. The reflectors could be disposed in the fixtures so as not as to come into contact with each other or the interior surfaces of the fixture housing itself or could be positioned in contact with each other or the lighting fixture. The reflector produces a significant improvement in illumination in either configuration.

In use the reflector of the system of the present invention is positioned so that at least a portion of the reflector 10 is spaced from the lamp 12 to cause essentially all the light emitted from a fluorescent lamp to be directed toward the intended illuminated area such as a work surface in an office, factory or display area, thus improving the level of illumination without requiring any increase in electricity consumed. The degree of curvature of the reflector may be selected to distribute the emitted light in a desired pattern. Tests have been conducted to evaluate the effectiveness of the present invention in improving the level of illumination. Using four four-foot F40CW-RS-WM 34-watt fluorescent lamps (a high efficiency lamp sold under the trademark Watt-Miser ® by assignee) having a diameter of about 1.5 inches, the level of illumination on a work table three feet wide by eight feet long located at six feet, nine inches below the surface of the fixture was measured at a plurality of locations. The average illumination received by the table surface with a bare fluorescent lamp was 40.8 footcandles. Table 1 shows the average level of illumination in footcandles over the surface of the table and the ratio of the average illumination level for each compared to the level of average illumination with a bare lamp for various widths of reflector.

TABLE 1

| Reflector Width | Illumination | Ratio |
|---|---|---|
| Bare Lamp | 41 Fc | |
| 2" Ref. | 37 Fc | 0.90 |
| 3" Ref. | 39 Fc | 0.95 |
| 4" Ref. | 41 Fc | 1.00 |
| 5" Ref. | 49 Fc | 1.20 |
| 6" Ref. | 51 Fc | 1.24 |
| 7" Ref. | 58 Fc | 1.41 |
| 8" Ref. | 54 Fc | 1.32 |

As shown in Table 1, the improvement over the bare lamp was at a maximum for a 7" wide reflector which showed a 41.6% improvement in illumination at the table surface. It has been found that the improvement in level of illumination is most pronounced when the reflector width is between 1 and 2 times the circumference of the lamp. The decrease shown for the 8" reflector is due to the fact that at the 8" width, the reflector contacted the lens covering of the fixture, distorting the shape and reducing the illumination on the work surface. Therefore the light detectors located at positions affected by the distortion of the reflector indicated only a low level of illumination. If the reflector is made of a material having sufficient resilience, the shape of the reflector after installation will concentrate the light from the fluorescent tube in a desired cone-shaped pattern on the work surface. The supporting ribs as shown in FIG. 3 can be employed to provide the necessary shaping to the reflector to enable focusing on a portion of an intended area. With the frictionally engaged collars on the lamp as shown in FIG. 3 the reflector may be turned so that the light from the lamp is directed in a generally horizontal pattern instead of a generally vertically downward pattern to illuminate a wall, display or similar vertical surface. The conformable reflector may also be used to focus the light emitted by a fluorescent lamp onto a narrow area to highlight or brighten a particular area.

Figure 5:
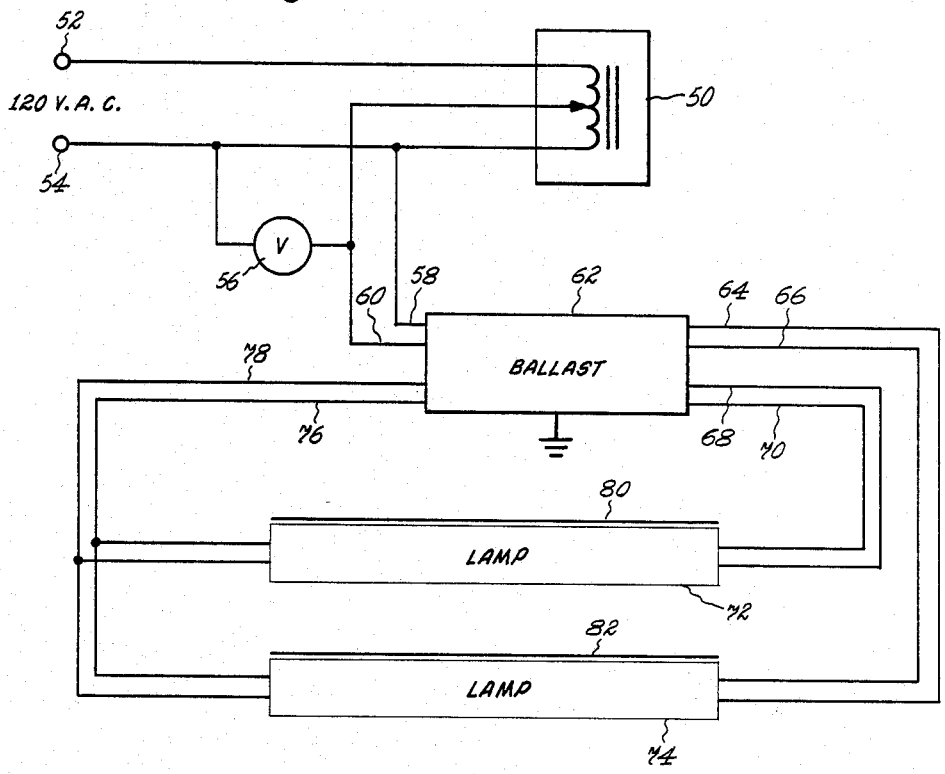
FIG. 5 is a schematic circuit diagram illustrating the test set up used to evaluate the effectiveness of a particular conductive reflector of the present invention as a starting aid.

It has also been discovered that if the reflector is conductive, it serves as a starting aid to assist starting the fluorescent lamp to which it is attached. The conductive reflector may be either a metallized reflector or a sheet of conductive foil, which when placed in close proximity to the fluorescent lamp causes drift of the ions within the glass lamp envelope during electrode heating by the flow of electrical current therethrough. A test has been performed to verify this phenomenon when using the fluorescent lamps with reflectors as shown in FIGS. 1 and 2. The test arrangment is shown schematically in FIG. 5. A variable autotransformer 50 is connected at terminals 52, 54 to a 120 volt a-c input line. A volt meter 56 is connected across the output from the secondary winding to measure the output voltage from the autotransformer 50. The output from the autotransformer (a power stat type 3PN116B) 50 is applied to the inputs 58, 60 of a fluorescent lamp ballast 62 (of the type sold by General Electric Company, Catalog No. 8G1022W) whose output lines 64, 66 and 68, 70 are connected respectively to parallel connected fluorescent lamps 72, 74, which are connected to ballast leads 76,78. The two fluorescent lamps used did not have a tin oxide or other starting aid coating disposed on the interior surface of the glass. By applying 120 volts to the input of the autotransformer 50 it was verified that neither of the lamps 72, 74 would start with the circuit shown. Reflectors 80, 82 of the type described herein were then taped onto the lamps 72, 74 respectively. With the same circuit and lamp arrangement except for the addition of the reflectors when 120 volts was applied to the input of the autotransformer 50, both of the lamps 72, 74 with the reflectors did start. It was further found that merely touching a small area of the conductive reflecting material onto the lamps was sufficient to cause the lamps to start. Therefore, it appears that the reflectors described herein can also be selected to exhibit electrical properties which are favorable during starting of fluorescent lamps. The conductive plane may be used to ensure starting of standard fluorescent lamps, or render unnecessary the utilization of tin oxide coatings or other starting aids on certain types of difficult to start fluorescent lamps such as T-8 (one inch diameter) lamps. In applications where no starting assistance is required or desireable a nonconductive reflective material may be used as the reflector.

It will be readily apparent to those skilled in the lighting art that the lamp reflector arrangment of the present invention may be employed with a wide variety of fluorescent lamps to enhance and control the illumination of a particular area and provides unique advantages in maximizing the utilization of light output by fluorescent lamps.

What we claim as new and desire to secure by Letters Patent of the United States is:

1. A fluorescent lamp system comprising:

an elongated generally circular fluorescent lamp; and conformable reflector means securely attached to said lamp and extending substantially parallel therewith along substantially the entire length of said lamp for directing light emitted by said lamp in a predetermined direction; said conformable reflector means comprising a sheet of material sufficiently compliant to be wrapped closely around said lamp or alternatively and selectively to be extended to a desired position at which at least a portion of said reflector means is spaced from said lamp to direct substantially the entire light output of said lamp in a desired direction relative to said lamp.

2. The invention of claim 1 further comprising:

attachment means for securing said reflector means to said lamp.

3. The invention of claim 2 wherein said attachment means comprises:

a plurality of collars tightly surrounding said lamp and attached securely to said reflector.

4. The invention of claim 1 wherein the width of said reflector means comprises:

a dimension in the range of 1 to 2 times the circumference of said fluorescent lamp.

5. The invention of claim 2 wherein said attachment means comprises:

a stripe of glue disposed between said lamp and said reflector and extending along substantially the entire axial length of said lamp.

6. The invention of claim 1 wherein said reflector means comprises:

a sheet of compliant plastic material having a layer of metallization disposed on the major surface thereof adjacent to said lamp.

7. The invention of claim 1 wherein said reflector means comprises:

a sheet of metal foil.

8. The invention of claim 1 wherein said reflector means comprises:

a sheet of reflective plastic material.

* * * * *